US009702654B2

(12) United States Patent
Brooker

(10) Patent No.: US 9,702,654 B2
(45) Date of Patent: Jul. 11, 2017

(54) HELICALLY WOUND PULL THROUGH GUN CLEANING DEVICE

(71) Applicant: Otis Products, Inc., Lyons Falls, NY (US)

(72) Inventor: James R. Brooker, Constantia, NY (US)

(73) Assignee: Otis Products, Inc., Lyons Falls, NY (US)

( * ) Notice: Subject to any disclaimer, the term of this patent is extended or adjusted under 35 U.S.C. 154(b) by 0 days.

(21) Appl. No.: 15/013,282

(22) Filed: Feb. 2, 2016

(65) Prior Publication Data

US 2016/0223282 A1 Aug. 4, 2016

Related U.S. Application Data

(60) Provisional application No. 62/111,315, filed on Feb. 3, 2015.

(51) Int. Cl.
*F41A 29/02* (2006.01)

(52) U.S. Cl.
CPC ..... *F41A 29/02* (2013.01)

(58) Field of Classification Search
CPC . F41A 29/02; F41A 29/00; B08B 9/00; B08B 9/04; B08B 9/0436; A46B 2200/3013; A46B 5/0095
USPC ..... 42/95; 15/104.05, 88
See application file for complete search history.

(56) References Cited

U.S. PATENT DOCUMENTS

| | | | | |
|---|---|---|---|---|
| 2,897,525 | A | 8/1959 | Goodwin et al. | |
| 4,503,578 | A * | 3/1985 | McIntyre | F41A 29/02 15/104.165 |
| 4,716,673 | A * | 1/1988 | Williams | F41A 29/02 15/104.16 |
| 5,171,925 | A * | 12/1992 | Mekler | F41A 29/02 15/104.165 |
| 8,065,772 | B2 * | 11/2011 | Maguire, Jr. | A46B 3/18 134/22.11 |
| 8,146,284 | B2 * | 4/2012 | Smith | A46B 3/18 134/8 |
| 8,176,592 | B1 * | 5/2012 | Carpenter | B08B 9/00 15/104.16 |
| 8,186,092 | B2 * | 5/2012 | Williams | F41A 29/02 15/104.2 |
| 8,763,298 | B2 * | 7/2014 | Smith | A46B 3/18 134/8 |
| 9,115,945 | B2 * | 8/2015 | Williams | F41A 29/02 |
| 9,115,947 | B2 * | 8/2015 | Williams | F41A 29/02 |
| 9,441,903 | B2 * | 9/2016 | Brooker | F41A 29/02 |

(Continued)

OTHER PUBLICATIONS

ISA/US International Search Report and Written Opinion for Corresponding International Application No. PCT/US16/16311, date of mailing Apr. 11, 2016 (10 pgs).

*Primary Examiner* — Jonathan C Weber
(74) *Attorney, Agent, or Firm* — Harris Beach PLLC

(57) ABSTRACT

A helically wound pull through gun cleaning device includes a central member. At least one helical over-mold is over-molded over a portion of the central member and defines a helical path. The central member substantially conforms to the helical path. A tubular woven sheath overlays and conforms to the central member and is close woven over the central member and the at least one overmolded helical section.

22 Claims, 9 Drawing Sheets

(56) References Cited

U.S. PATENT DOCUMENTS

| | | | | |
|---|---|---|---|---|
| 2001/0016962 | A1* | 8/2001 | Moore | B08B 9/00 15/104.16 |
| 2011/0047853 | A1 | 3/2011 | Williams | |
| 2011/0099880 | A1 | 5/2011 | Stephens et al. | |
| 2011/0168207 | A1* | 7/2011 | Smith | A46B 3/18 134/8 |
| 2011/0289705 | A1* | 12/2011 | Asano | A61B 1/122 15/104.05 |
| 2012/0198639 | A1* | 8/2012 | Smith | A46B 3/18 15/104.05 |
| 2014/0123529 | A1* | 5/2014 | Williams | F41A 29/02 42/95 |
| 2014/0123530 | A1* | 5/2014 | Williams | F41A 29/02 42/95 |
| 2016/0223283 | A1* | 8/2016 | Brooker | F41A 29/02 |
| 2016/0223284 | A1* | 8/2016 | Brooker | F41A 29/02 |

* cited by examiner

HELICALLY WOUND PULL THROUGH GUN CLEANING DEVICE

CROSS-REFERENCE TO RELATED APPLICATIONS

This application claims priority to and the benefit of U.S. provisional patent application Ser. No. 62/111,315, HELICALLY WOUND PULL THROUGH GUN CLEANING DEVICE, filed Feb. 3, 2015, which application is incorporated herein by reference in its entirety.

FIELD OF THE APPLICATION

The invention relates to a gun cleaning tool, and particularly to a pull through gun cleaning tool.

BACKGROUND

Barrels of firearms are difficult to clean. Carbon and other residue from gunpowder and from firearm discharge reactions accumulate in firearm barrels, with deleterious effects on cleanliness, performance, and longevity of the firearm. Such residues require partial disassembly of a weapon to access and clean the barrel and associated firing chamber. A number of specialized swabbing, brushing and scraping tools have been introduced to clean firearm components, but have had substantial shortcomings.

SUMMARY

According to one aspect, a helically wound pull through gun cleaning device includes a central member. At least one helical over-mold is overmolded over a portion of the central member and defines a helical path. The central member substantially conforms to the helical path. A tubular woven sheath overlays and conforms to the central member and is close woven over the central member and the at least one overmolded helical section.

In one embodiment, the helical section overmolded over a helical portion of the central member includes an outer surface with helical ridges and helical troughs disposed between the helical ridges.

In another embodiment, the helical section overmolded over a helical portion of the central member includes an elliptical cross section modified by the helical ridges and the helical troughs.

In yet another embodiment, the helical section overmolded over a helical portion of the central member includes a plastic over-mold.

In yet another embodiment, the plastic over-mold includes a thermo-plastic.

In yet another embodiment, the central member includes a coated cable.

In yet another embodiment, the coated cable includes a coating selected from the group consisting of nylon, vinyl, and plastic.

In yet another embodiment, the central member includes a steel wire.

In yet another embodiment, the tubular woven sheath includes a natural fiber.

In yet another embodiment, the tubular woven sheath includes a synthetic fiber.

In yet another embodiment, the tubular woven sheath includes a fiber selected from the group consisting of a heat resistant material, a meta-aramid, a NOMEX, a para-aramid, a KEVLAR™, a fiberglass, and a K-fiber.

In yet another embodiment, the tubular woven sheath includes a fiber selected from the group consisting of a nylon, a polystyrene, an acetal, an acrylic, a metallic thread, and a brass metallic thread.

In yet another embodiment, the tubular woven sheath includes a phosphorescent thread or a luminescent thread.

In yet another embodiment, the gun cleaning device further includes a fitting disposed at one or both ends of the gun cleaning device.

In yet another embodiment, the gun cleaning device further includes a T-handle mechanically coupled to an end of the central member by the fitting.

In yet another embodiment, the gun cleaning device further includes an accessory swab attachment mechanically coupled to an end of the central member by the fitting.

In yet another embodiment, the gun cleaning device further includes an accessory brush attachment mechanically coupled to an end of the central member by the fitting.

In yet another embodiment, the gun cleaning device further includes an accessory scraper attachment mechanically coupled to an end of the central member by the fitting.

In yet another embodiment, the gun cleaning device further includes disposed within the at least one helical over-mold an additional structural member including a different material than a material of the at least one helical over-mold to enhance a memory of the helical path.

According to another aspect, a method to manufacture a helically wound pull through gun cleaning device including: providing a central member; forcing the central member into a helical shape; overmolding the central member with a thermo plastic to form at least one helical section overmolded over a helical portion of the central member so that the central member maintains the helical shape over the helical portion after the thermo plastic cools or cures; and weaving a tubular woven sheath over the central member and the at least one overmolded helical section.

In one embodiment, the method further includes the step of affixing a fitting to at least one end of the central member.

According to another aspect, a helically wound pull through gun cleaning device includes a central member. At least one helical over-mold is overmolded over a portion of the central member and defines a helical path. The central member substantially conforms to the helical path. A tubular woven sheath is disposed over the at least one helical over-mold. Beyond the at least one helical over-mold the tubular woven sheath is disposed over the central member to form a pull cord. A total length of the pull cord is configured such that where the at least one helical over-mold is inserted into one end of a barrel, the pull cord extends past another end of the barrel. An uncompressed outside diameter of the at least one helical over-mold is larger than a bore of the barrel and when compressed by insertion into the bore of the at least one helical over-mold provides a radial force pressing the tubular woven sheath of the at least one helical over-mold against an inside surface or a rifling of the barrel.

The foregoing and other aspects, features, and advantages of the application will become more apparent from the following description and from the claims.

BRIEF DESCRIPTION OF THE DRAWINGS

The features described herein can be better understood with reference to the drawings described below. The drawings are not necessarily to scale, emphasis instead generally being placed upon illustrating the principles of the invention. While the particular embodiments are described in relation to cleaning the interior of a gun barrel, individuals skilled in the art will recognize and understand that the disclosure and embodiments herein are equally applicable to cleaning pipes, conduits and tubing that is both straight and curved. In the drawings, like numerals are used to indicate like parts throughout the various views:

FIG. 3 shows a more detailed view of the helically wound section looking end on;

DETAILED DESCRIPTION

A system and tool for cleaning the interior of tubular members is described hereinbelow. In one embodiment, a cleaning device includes a central member supporting a region of overmolded elastomer around the cable core. The system can also include a tubular woven sheath surrounding at least a portion of the overmolded elastomer. The central member can include a fitting at one end and preferably at both ends for attachment to any of various auxiliary tools such as swabs, brushes, scrapers, handles, adapters and the like. The system and tools described herein are suitable for the cleaning of the barrels of firearms, such as the barrels of rifles, carbines, pistols.

Other types of pull through gun cleaning devices have been described, such as, for example, in co-pending U.S. patent application Ser. No. 13/785,966, APPARATUS AND METHOD FOR CLEANING THE BARREL OF A FIREARM filed Mar. 5, 2013, and co-pending U.S. patent application Ser. No. 14/076,713, APPARATUS AND METHOD FOR CLEANING THE BARREL OF A FIREARM filed Nov. 11, 2013, and co-pending U.S. Patent Application Ser. No. 62/111,391, MANDREL BASED HELICAL PULL THROUGH GUN CLEANING DEVICE, filed Feb. 3, 2015, 2015, and co-pending U.S. Patent Application Ser. No. 62/111,445, PULL THROUGH GUN CLEANING DEVICE WITH ONE OR MORE CYLINDRICAL DOUBLE CONED SHEATHED PRESSURE SECTIONS, filed Feb. 3, 2015, all applications also assigned to the present assignee, Otis Products, Inc. All of the above named applications are incorporated herein by reference in their entirety for all purposes.

Figure 1:
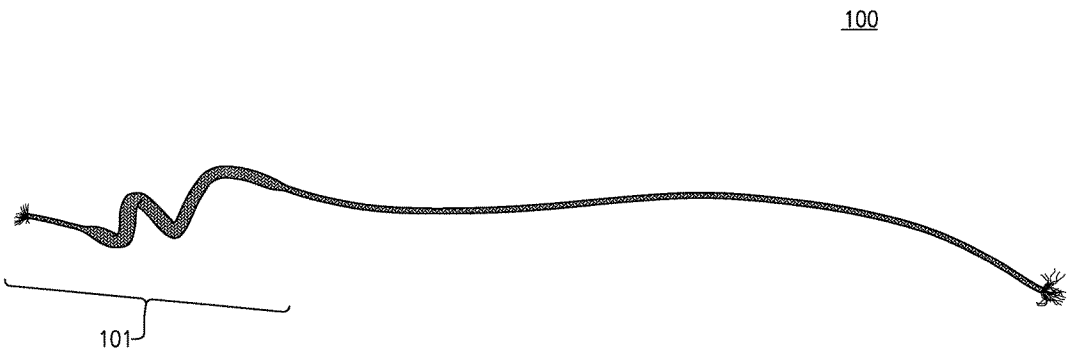
FIG. 1 shows a helically wound pull through gun cleaning device.

A new helically wound pull through gun cleaning device is now described in more detail. FIG. 1 shows one exemplary embodiment of a helically wound pull through gun cleaning device 100. One difference over gun cleaning devices of the prior art is the "pig tail" helically wound section 101. The helically wound section 101 can for formed by any suitable material which creates the helical shaped bend of the central member core structure as well as which offers some elasticity of the helically wound section 101. The elasticity aspect helps to hold the helical shape which presses the helically wound section 101 against the inside of a gun barrel bore or gun barrel rifling as the helically wound pull through gun cleaning device is pulled through the barrel of a weapon. A helically wound pull through gun cleaning device can have one or more helically wound sections.

Figure 2:
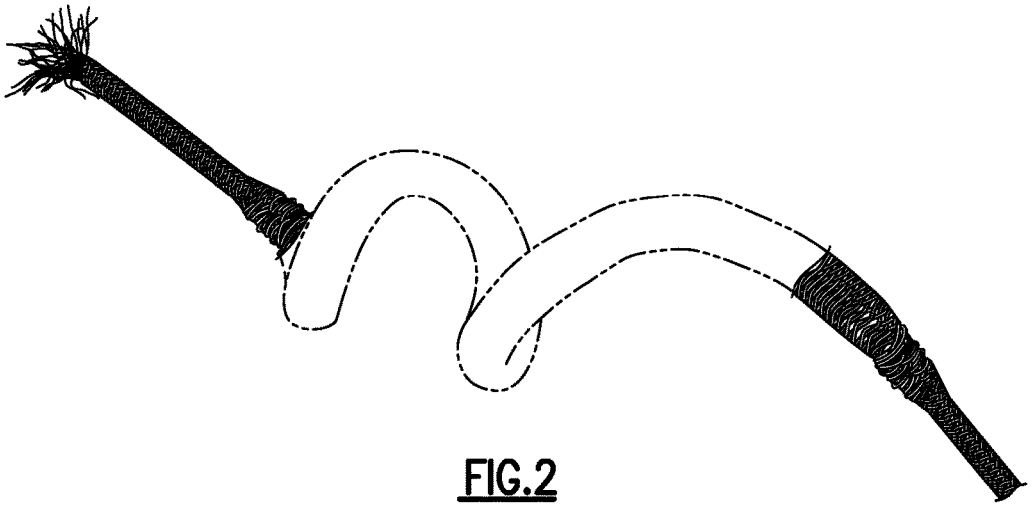
FIG. 2 shows a more detailed view of the helically wound section looking from above the pull through cord.
Figure 3:
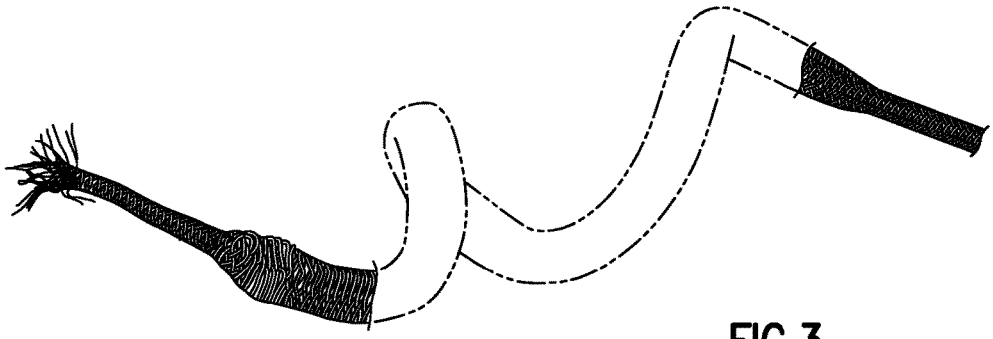

FIG. 2 shows a more detailed view of the helically wound section 101 looking from above the pull through cord. FIG. 3 shows a more detailed view of the helically wound section 101 looking end on.

FIG. 1, FIG. 2, and FIG. 3 are illustrations of a prototype tool made with emphasis on the helically wound section 101 and the underlying same shaped thermal plastic overmolded member which gives the helically wound section 101 its shape and elasticity. There can also typically be a fitting attached at either end, such as, for example, a threaded brass fitting. A fitting can be affixed to the pig tail end of the helically wound section 101 and/or the opposite end by any suitable means, such as by crimping, or gluing, such a gluing with an epoxy. The fitting or coupling can be made with any suitable fastening technique adapted to accept a removable and/or interchangeable cleaning accessory and/or a T-handle or other pull structure that can be conveniently grabbed by hand. As to accessory tools, any number of different sizes and types of brushes or patch holders can be affixed to the end of helically wound pull through gun cleaning device 100. A threaded metal coupling, such as a threaded brass coupling can be crimped to the end of the tool for so attached accessory tool parts. However, any suitable type of metal or plastic threaded or snap arrangement (e.g. a nylon or plastic snap connector) can be used to affix an accessory tool to either end of the pull through tool.

Typically, a plastic covered stranded steel wired forms the center core or central member of the tool helically wound pull through gun cleaning device 100. In the region of the helically wound section 101, a second plastic of the same type, or more typically another type of thermally formed plastic can be overmolded over the center core. It is the overmolded section which typically holds the center core in the helical shape in this region of the helically wound section 101. The helically wound section 101 and more typically the entire length of the pull through gun cleaning device 100 including the helically wound section 101 can be covered by a tubular woven sheath.

In many embodiments, an outer tubular woven sheath conforms tightly or snuggly to the helically wound section 101. In some embodiments the tubular woven sheath can be slid on to the central member and helically wound section 101. In some of those embodiments, the tubular woven sheath can be slid off of the central member and helically wound section 101 for cleaning. In some embodiments the tubular woven sheath conforms very tightly to the helically wound section 101 and is not intended to be removed. Some embodiments where the tubular woven sheath conforms very tightly can be washed as a complete tool including the central member and helically wound section 101.

The tubular woven sheath can be moistened, wetted, or dipped with any suitable gun barrel cleaning or lubricating material. Such gun barrel cleaning or lubricating materials are typically applied as a liquid to the tubular woven sheath, particularly where the outer surfaces of the tubular woven sheath over the helically wound section 101 will come in contact with the inner surface of the gun barrel.

There is typically compression of the helically wound section 101 to increase the force against the inner surface of the barrel and/or rifling of the inner surface of the barrel. Accordingly, there is typically, but not necessarily, a larger relaxed outside diameter of a helically wound section, and a somewhat smaller compressed outside diameter of a helically wound section when it is inserted in a gun barrel for pull through cleaning of the barrel. There can be near optimally sized helically wound sections for a particular weapon or barrel bore size, or there can be embodiments where a helically wound pull through gun cleaning device can fit more than one type of weapon and/or more than one gun barrel bore or inside diameter. However, more typically, a helically wound pull through gun cleaning device 100 can be manufactured for a specific diameter gun barrel bore.

Figure 4:
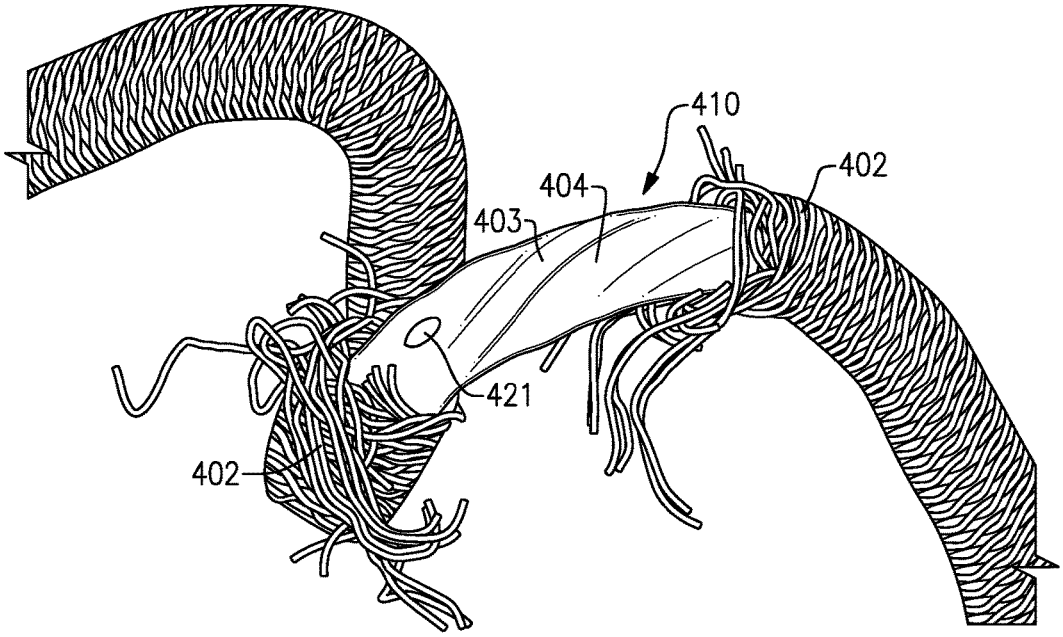
FIG. 4 shows an illustration of an exemplary helical over-mold.

FIG. 4 shows an illustration of an exemplary helical over-mold (at least one helical over-mold). Tubular woven sheath 402 has been cut and pulled away from a portion of the helically wound section 101, exposing the exemplary helical over-mold 410. The exemplary helical over-mold 410 has molded surface features, typically made from the same material as the entire helical over-mold 410, such as, for example, helical ridges 404 and helical troughs 403. A helical over-mold 410 can have any suitable cross section, such as, circular, square, rectangular, polygon, or elliptical as shown in the exemplary embodiment of FIG. 4.

Figure 5:
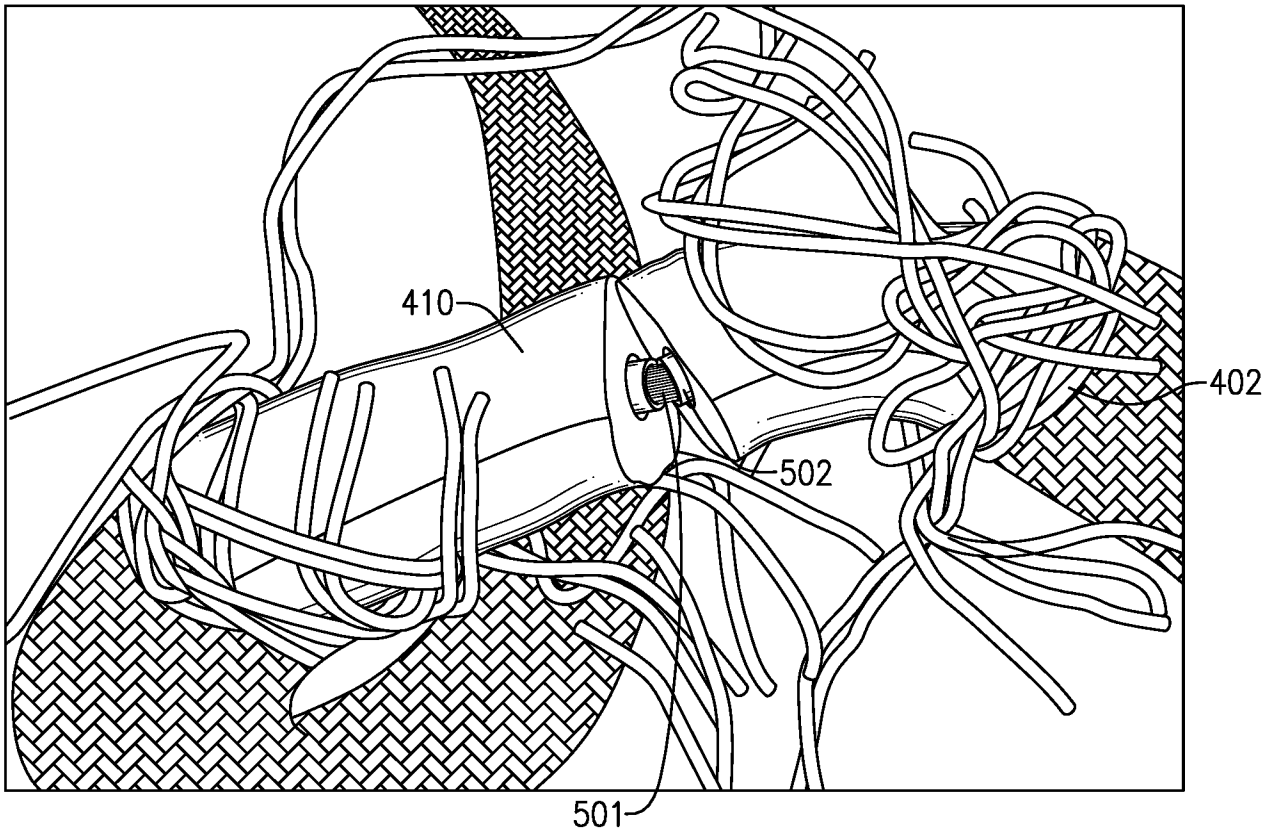
FIG. 5 shows an illustration the helical over-mold of FIG. 4 cut open.

FIG. 5 shows an illustration the helical over-mold of FIG. 4 cut open to illustrate a partial cross section. The exemplary helical over-mold 410 of FIG. 4 is cut open in FIG. 5 showing the exemplary elliptical cross section also showing an exemplary coated cable central member including wire rope 502 and coating 502.

The helical over-mold or a helical part that can be placed over a central core can be formed of any suitable material, such as, for example wood or plastic, such as, a thermoplastic. The helical over-mold can be formed from a thermoplastic by any suitable thermoplastic manufacturing technique, such as, for example, thermoplastic molding. The helical over-mold can be made from any suitable material, typically a material that offers some compressibility so that once compressed the combination of the compressed sheath and helical winding provides an outward pressure perpendicular to the center line of the bore so as to force the cleaning sheath against the interior surface of the bore (smooth or rifled) so that the sheath is forced against the interior surface as the sheathed helical section is pulled through the barrel. For example, the helical over-mold can be formed of a thermosetting rubber polymer, such as by injection molding onto the coating 502 of the central member 600 (FIG. 6B) defined by coating 502 over wire rope 501 of the pull cord 103. Any suitable material, such as for example, any suitable thermoplastic elastomer can be used.

In most embodiments, the "memory" of the uncompressed helical over molding provides a substantially 360 degree cleaning around the interior bore of a barrel of a weapon. In other words, the helical section compresses to provide a radial force pressing the tubular woven sheath over the helical over mold against an inside surface or a rifling of the barrel. In most embodiments, the memory of the uncompressed helical radius is provided by the shape memory of the over mold, such as a thermoplastic over mold. However, it is also contemplated that the helical over mold could include more than one type of material, such as an additional structural member made from a different material. For example, it is contemplated that there could be disposed within a thermoplastic helical over mold an additional strand or member of another type of plastic or metal which further enhances the memory shape of the uncompressed helical section. For example, it is contemplated that an over molded thermoplastic helical section could include disposed within, a section of another type of stiffer or more rigid plastic rod or strip, or a section of a shape memory metal (SMA), such as for example a section of SMA wire to enhance the memorized helical shape.

Figure 6A:
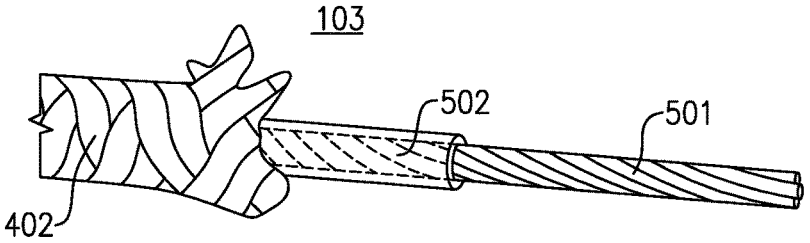
FIG. 6A shows an illustration of an exemplary coated cable central member.
Figure 6B:
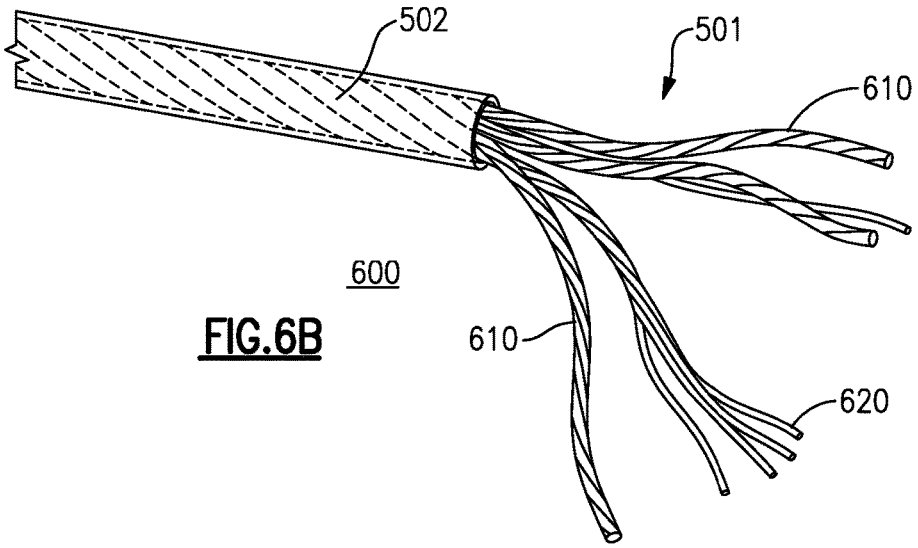
FIG. 6B shows an illustration of the stranding of the wire rope of the coated cable central member of FIG. 6A.

FIG. 6A shows an illustration of an exemplary coated cable central member 600. Wire rope 501 is typically formed from a plurality of strands or bundles, each bundle having a plurality of wires. The coating 502 can be formed form any suitable material, such as, for example, nylon, vinyl, plastic, or any other suitable material which can accept a helical over-mold 410. FIG. 6B shows an illustration of the stranding of the wire rope of the coated cable central member 600 of FIG. 6A. The exemplary central member coated cable 501 of FIG. 6B has a coating 502 over 5 bundles of 7 wires each. Typically the wires are made from steel, such as, for example, stainless steel, galvanized steel, or zinc coated steel. The central member 600 can be made from a coated cable 501 and can be, for example, a pre-assembled coated aircraft cable wire, or any other suitable commercially available pre-assembled coated cable wire which is well-known in the art.

EXAMPLE

The following prototype helically wound pull through gun cleaning device was manufactured. The exemplary tool was about 30" long. The helically wound section was about 6" long and about 1.5" in diameter (uncompressed by the barrel of a weapon). The pull cord, or long straight section was about 0.15" in diameter including the tubular woven sheath over the coated cable. The helical over-mold with roughly an elliptical cross section was about 0.38"×0.26" (including ridges and troughs). The central member had a diameter of the cable coating of about 0.094" and a diameter of the wire rope of about 0.065". The wire rope was made from 5 bundles of 7 zinc plated wires, each wire having a diameter of about 0.007".

While the exemplary embodiments described hereinabove are based on a coated wire cable, the central member can comprise any suitable material or elongate form, e.g., fiber rope or cord, rod, wire, or twisted or braided cable and can be rigid, semi-rigid or semi-flexible. The rigid or semi-rigid structure of a helically wound pull through gun cleaning device makes it an excellent gun barrel obstruction remover. In some embodiments, the central member can have sufficient rigidity to be easily threaded or passed through the tubular member. A wire cable as described hereinabove can also be formed of a metal such as galvanized steel, preferably formed to have a natural curl for ease of laterally coiling in storage and preferably having a protective plastic coating. The protective plastic coating reduces the risk of scratching gun components and the potential for fraying of the cable. With respect to the cleaning of tubular members other than gun barrels, a semi-rigid structure of the core can accommodate some slight or eventual curves in the interior of a pipe, conduit or tube. However, a semi-flexible core member is preferable for cleaning sections of pipe, conduit or tubes having substantially curved shapes and turns between straight segments of tubular members.

Figure 7:
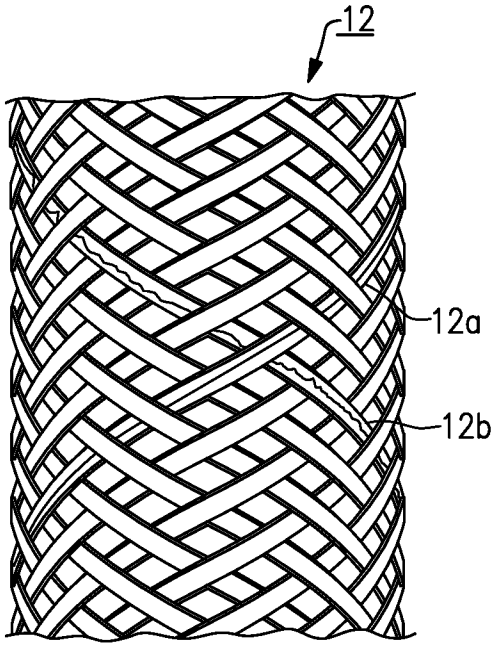
FIG. 7 is an elevational view of a portion of a tubular woven sheath in accordance with the present invention.

FIG. 7 shows an exemplary tubular woven sheath. Sheath 12 can be woven of primarily a natural fiber such as cotton, although synthetic fiber can be included; and 100% synthetic fiber is fully comprehended by the invention. Many natural fibers are sufficiently absorbent to retain adequate amounts of cleaning solvent without the need for sections of additional absorbent sponges between the sheath and the core. Additional special-purpose threads, such as fiber-optic 12*a*, phosphorescent or luminescent threads 12*b*, can also be woven into the sheath to provide, for example, auxiliary lighting for visual inspection of a gun barrel for cleanliness as tool 10 is withdrawn. In another aspect of the invention, the woven sheath can comprise fibers of heat resistant materials, such as meta-aramids, NOMEX, para-aramids, KEVLAR, fiberglass, K-fiber, or the like. In another aspect of the invention, synthetic fibers, such as nylon, polystyrene, acetals, acrylics or the like, or metallic thread, such as brass or the like, can be incorporated into the sheath to increase the abrasive characteristic of the sheath to assist in removal stubborn residue from the barrel. Sheath 12 can be woven, for example, on a tubular commercially available braiding machine Where the sheath is comprised of heat resistant fibers or materials, cleaning of the sheath can also be performed by the application of sufficient heat to burn off the accumulated residue. For example, the tool 10 or the sheath 12 could be placed in an oven at a temperature below the melting or deformation temperature of the fibers such that any dirt or carbon residue detaches from the fibers of the sheath.

Figure 8:
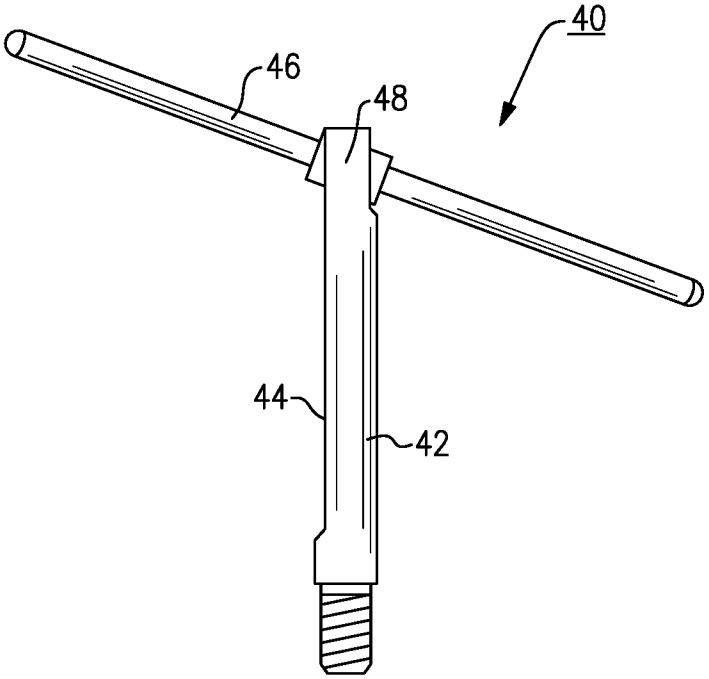
FIG. 8 is an elevational view of a foldable T-handle, also referred to interchangeably herein as a "pull-through handle tool", formed for passage in folded configuration through the barrel of a weapon.

Referring now to FIG. 8, an exemplary foldable T-handle 40, comprising a threaded shaft 42 having a longitudinal well 44 and a pivotable handle 46 attached to shaft 42 by pin 48 formed for passage in folded configuration through the bore of a weapon, is attachable to either of fittings 28, either before or after passage through a gun barrel of a leading end of apparatus 10, to assist a user in pulling apparatus 10 through a gun barrel. Where embodiments of the invention are used to clean the interior of tubular members having curved shapes, the T-handle is preferably attached to the fitting at the leading end of the central member after it is threaded through the tubular member. Where the interior of the tubular member is straight, a slim profile T-handle can be attached to the fitting at the leading end of the central member, or can be integrated with the fitting at the leading end of the central member. An exemplary slim profile T-handle is disclosed in U.S. patent application Ser. No. 13/448,973 entitled "Firearm Pull-Through Cleaning Tool with Integrated Foldable Handle," filed on Apr. 17, 2012 assigned to the common assignee of this application, which is hereby incorporated by reference in its entirety.

Figure 9:
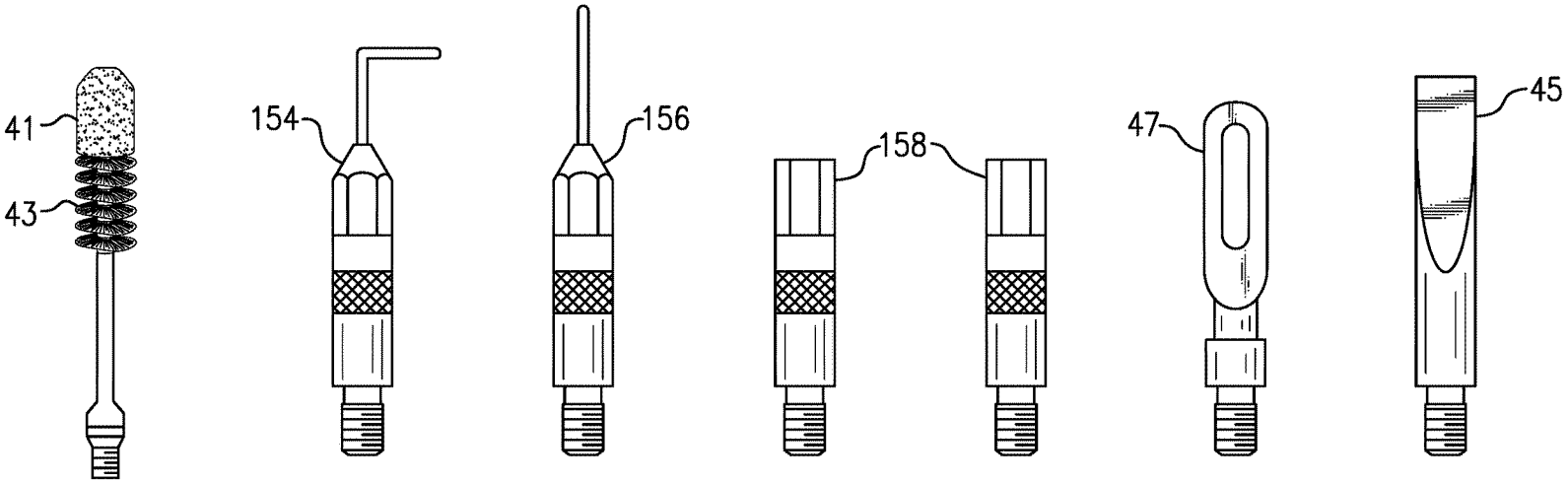
FIG. 9 depicts an assortment of typical auxiliary tools adapted to attach to the fittings at the end of the central member.
Figure 10A:
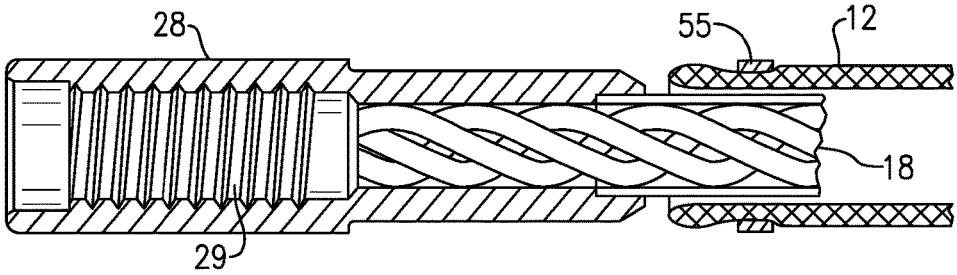
FIG. 10A depicts a crimping ring retaining the tubular woven sheath on the central member.
Figure 10B:
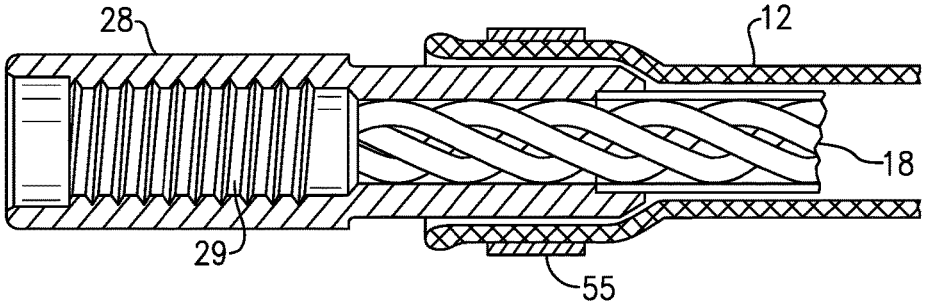
FIG. 10B depicts another embodiment wherein the crimping ring retains the sheath against a fitting at the end of the central member.

With reference to FIG. 9, FIG. 10A and FIG. 10B, central member 18 preferably includes a fitting 28 at one end, and preferably at both ends, for attachment to any of various auxiliary tools such as swabs 41, brushes 43, scrapers 45, tips 47, a T-handle 51, and the like, as well as a cable extender and/or serially connection additional gun barrel cleaning tools 10. The fittings can be crimped, bonded or cold welded to the end of the central member. The fittings 28 can have internal or external threads 29 or other quick connect mechanisms to couple with the fittings of the auxiliary tools as depicted in FIG. 9.

Figure 11:
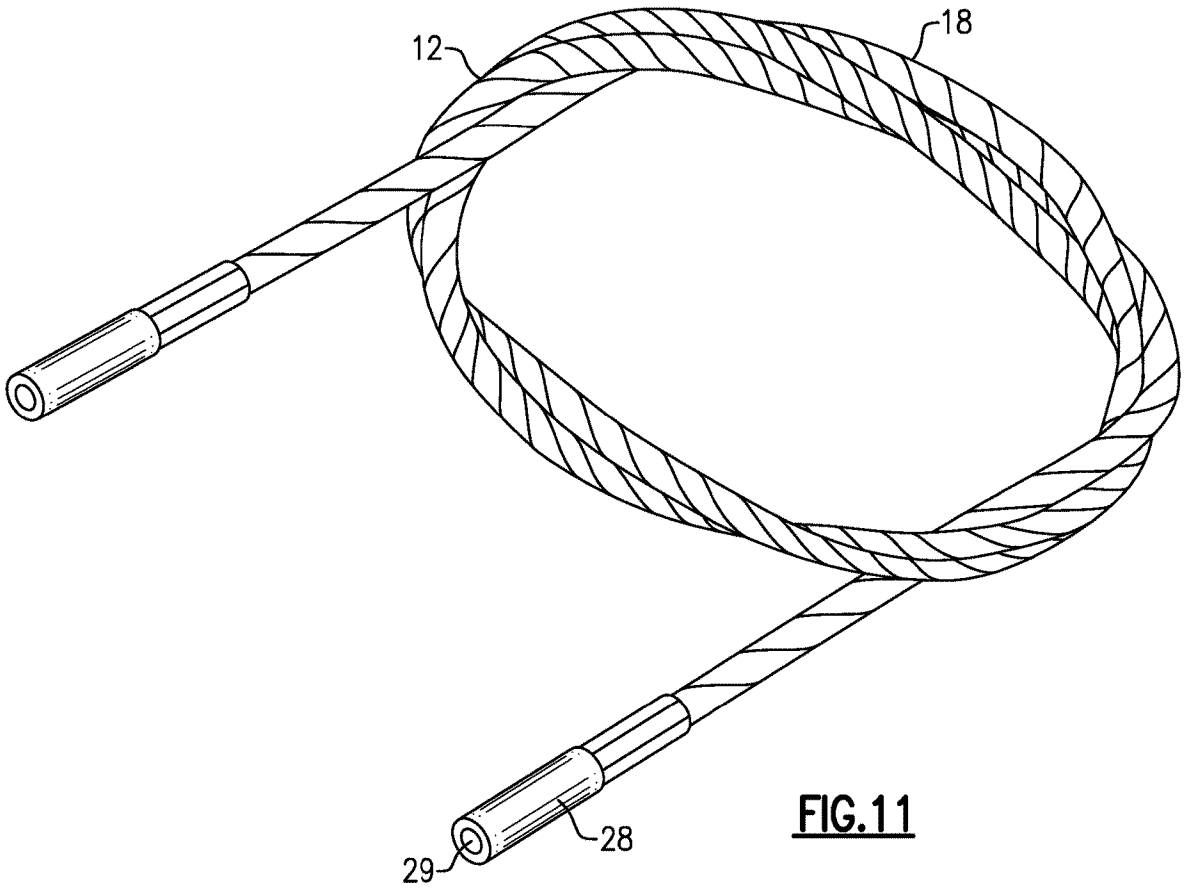
FIG. 11 depicts an embodiment of a central member having fittings on the leading and trailing ends thereof in a coiled position.

FIG. 11 depicts an embodiment of a central member having fittings on the leading and trailing ends thereof in a coiled position. While not showing a helically wound pull through gun cleaning device, FIG. 11 shows how fitting can be affixed to either or both ends of a helically wound pull through gun cleaning device. In some embodiments, the fittings 28 can also be sized and configured to attach one or both of the leading or trailing end of the sheath to the central member. Alternatively, as depicted in FIG. 10A and FIG. 10B, a separate crimping ring 55 or other suitable connector can be utilized over the sheath 12 and the central member 18 or the fitting 28 to retain the edge of the sheath in place over the central core 18 and the sheath 12. In some embodiments, it may be sufficient to crimp over the central core alone.

In some embodiments, the sheath 12 is not connected to the fittings or central member 18, but held in place by the tight fit of the woven sheath 12. In other embodiments, the sheath can be removable from the tool for cleaning to remove build-up of removed residue. The sheath 12 can include elasticized threads to assist in the removal, cleaning and/or replacement of the sheath. Alternatively, cleaning can be accomplished by soaking the coiled tool in a suitable detergent solution and rinsed to remove the accumulated build-up of dislodged residue.

The respective thicknesses of the central core, protective layer, any overmolded protrusions, absorbent materials and the woven sheath can be varied to change the radial width of the tool to fit the gun barrels of differing calibers. Alternatively, the compressibility of any of the overmolded protrusions or the helical over-mold, absorbent material and/or the woven sheath can also be increased so that a single tool can appropriately clean a range of calibers of gun barrels.

In some embodiments, the natural fibers of the sheath and any absorbent material disposed beneath the sheath or at the trailing end of the central member can be used to absorb and remove spent cleaning fluids containing dislodged residue. However, in some embodiments, the overmolded thermoplastic region has been successfully deployed to clean a variety of relatively narrow tubular members without a sheath. A plurality of protrusions, including particularly, helical protrusions, or the helical over-mold, is effective at removing liquids and semi-solids such as grease and congealed oils, from narrow drains. An additional protrusions, or a plurality of protrusions, such as, for example, ridges of a helical over-mold can wipe excess accumulations of liquids and semi-solids in the manner of a squeegee from the interior of a pipe or drain. Even where a pipe or drain includes a catch or other curved portion, embodiments of the invention utilizing a semi-flexible central member were threaded through the drain and pulled through the tubular member. This embodiment removed excess accumulations of grease and spent oils in a small fraction of the time of other common methods.

It will be appreciated that variants of the above-disclosed and other features and functions, or alternatives thereof, can be combined into many other different systems or applications. Various presently unforeseen or unanticipated alternatives, modifications, variations, or improvements therein can be subsequently made by those skilled in the art which are also intended to be encompassed by the following claims.

What is claimed is:

1. A helically wound pull through gun cleaning device comprising:

a central member;

at least one helical over-mold, overmolded over a portion of said central member;

a tubular woven sheath;

a helically wound section comprising said a central member, said at least one helical over-mold, and said tubular woven sheath overlaying and conforming to said at least one helical over-mold;

a pull section extending from said helically wound section, said pull section comprising said central member and said tubular woven sheath overlaying and conforming to said central member; and wherein said central member, said at least one helical over-mold, and said tubular woven sheath of said helically wound section, together form a helix shaped structure which follows a helical path, said helically wound section defining an open void along a central longitudinal line of said helically wound section between a lead-in portion to a first end of said helically wound section and said pull section extending from an opposite second end of said helically wound section.

2. The gun cleaning device of claim 1, wherein said at least one helical over-mold comprises an outer surface with helical ridges and helical troughs disposed between said helical ridges.

3. The gun cleaning device of claim 2, wherein said at least one helical over-mold comprises an elliptical cross section modified by said helical ridges and said helical troughs.

4. The gun cleaning device of claim 1, wherein said at least one helical over-mold comprises a plastic over-mold.

5. The gun cleaning device of claim 4, wherein said plastic over-mold comprises a thermo-plastic.

6. The gun cleaning device of claim 1, wherein said central member comprises a coated cable.

7. The gun cleaning device of claim 6, wherein said coated cable comprises a coating selected from the group consisting of nylon, vinyl, and plastic.

8. The gun cleaning device of claim 1, wherein said central member comprises a steel wire.

9. The gun cleaning device of claim 1, wherein said tubular woven sheath comprises a natural fiber.

10. The gun cleaning device of claim 1, wherein said tubular woven sheath comprises a synthetic fiber.

11. The gun cleaning device of claim 1, wherein said tubular woven sheath comprises a fiber selected from the group consisting of a heat resistant material, a meta-aramid, a NOMEX, a para-aramid, a KEVLAR™, a fiberglass, and a K-fiber.

12. The gun cleaning device of claim 1, wherein said tubular woven sheath comprises a fiber selected from the group consisting of a nylon, a polystyrene, an acetal, an acrylic, a metallic thread, and a brass metallic thread.

13. The gun cleaning device of claim 1, wherein said tubular woven sheath comprises a phosphorescent thread or a luminescent thread.

14. The gun cleaning device of claim 1, further comprising a fitting disposed at one or both ends of said gun cleaning device.

15. The gun cleaning device of claim 14, further comprising a T-handle mechanically coupled to an end of said central member by said fitting.

16. The gun cleaning device of claim 14, further comprising an accessory swab attachment mechanically coupled to an end of said central member by said fitting.

17. The gun cleaning device of claim 14, further comprising an accessory brush attachment mechanically coupled to an end of said central member by said fitting.

18. The gun cleaning device of claim 14, further comprising an accessory scraper attachment mechanically coupled to an end of said central member by said fitting.

19. The gun cleaning device of claim 1, further comprising disposed within said at least one helical over-mold an additional structural member comprising a different material than a material of said at least one helical over-mold to enhance a memory of said helical path.

20. The gun cleaning device of claim 1, wherein an uncompressed outside diameter of said at least one helical over-mold is larger than a bore of a barrel and when compressed by insertion into said bore of said at least one helical over-mold provides a radial force pressing said tubular woven sheath of said at least one helical over-mold against an inside surface or a rifling of said barrel.

21. The helically wound pull through gun cleaning device of claim 1, wherein said central member of said helically wound section is maintained in said helix shaped structure with said open void along said central longitudinal line of said helix shaped structure by a helical bias of said at least one helical over-mold.

22. A helically wound pull through gun cleaning device comprising:

a central member;

at least one helical over-mold, overmolded over a portion of said central member and defining a helical path, said central member substantially conforming to said helical path, disposed within said at least one helical over-mold an additional structural member comprising a different material than a material of said at least one helical over-mold to enhance a memory of said helical path; and a tubular woven sheath overlaying and conforming to said central member and close woven over said central member and at least one overmolded helical section.

* * * * *